US007081865B2

(12) United States Patent
Wu et al.

(10) Patent No.: US 7,081,865 B2
(45) Date of Patent: Jul. 25, 2006

(54) METHOD AND APPARATUS FOR IMPROVING ANTENNA RADIATION PATTERNS

(75) Inventors: Cheng-Hsiung Wu, Kaohsiung (TW); Chang-Fa Yang, Hsin Chuang (TW)

(73) Assignee: National Taiwan University of Science and Technology, Taipei (TW)

( * ) Notice: Subject to any disclaimer, the term of this patent is extended or adjusted under 35 U.S.C. 154(b) by 21 days.

(21) Appl. No.: 10/925,955

(22) Filed: Aug. 26, 2004

(65) Prior Publication Data

US 2005/0062673 A1 Mar. 24, 2005

(30) Foreign Application Priority Data

Sep. 19, 2003 (TW) ..... 92126026 A

(51) Int. Cl.
*H01Q 1/42* (2006.01)

(52) U.S. Cl. ..... 343/872; 343/909

(58) Field of Classification Search ..... 343/909, 343/872, 873, 700 MS, 756, 768, 770; H01Q 1/42
See application file for complete search history.

(56) References Cited

U.S. PATENT DOCUMENTS

| | | | | |
|---|---|---|---|---|
| 3,961,333 | A * | 6/1976 | Purinton | 343/872 |
| 4,467,330 | A * | 8/1984 | Vidal et al. | 343/872 |
| 5,400,043 | A * | 3/1995 | Arceneaux et al. | 343/872 |
| 5,600,325 | A * | 2/1997 | Whelan et al. | 342/13 |
| 5,917,458 | A * | 6/1999 | Ho et al. | 343/909 |
| 6,396,451 | B1 * | 5/2002 | Wu et al. | 343/756 |

* cited by examiner

*Primary Examiner*—Hoanganh Le

(57) ABSTRACT

Several electromagnetic scattering structures are designed to improve antenna radiation patterns. The electromagnetic scattering structure has a conductive layer with certain patterns, and is applied on the radome of the base-station sector antenna. The electromagnetic waves radiating from the antenna therein induce scattering effects, which, together with the electromagnetic diffractions from the rear metal panel of the antenna, can substantially reduce the back lobe and the fields in regions not covered by the antenna. Thus, the antenna radiation patterns are improved so that a lower possibility of co-channel interferences between adjacent base stations can be achieved and therefore better efficiency of the base-station coverage also can be obtained.

5 Claims, 19 Drawing Sheets

METHOD AND APPARATUS FOR IMPROVING ANTENNA RADIATION PATTERNS

RELATED APPLICATION

The present application is based on, and claims priority from, Taiwanese Application Ser. No. 92126026, filed Sep. 19, 2003, the disclosure of which is herein incorporated by reference herein in its entirety.

BACKGROUND

1. Field of Invention

The present invention relates to an antenna apparatus. More particularly, the present invention relates to method and apparatus for improving antenna radiation patterns.

2. Description of Related Art

Mobile telephones are portable and wireless telephone devices installed on conveyances, such as vehicles and ships, or carried by a user. Mobile telephones are different from wireless extensions of the wired telephones or long distance radio transceivers. Mobile telephones provide users with the benefits of the same functions of and greater convenience than wired telephones. Connecting with international direct dialing, mobile telephone users can communicate with any other person in the world within coverage of a mobile telephone system.

A mobile telephone network system comprises mobile telephone switching offices (MTSO), base stations (BS) and mobile stations (MS). Generally, the mobile telephone network system may have one or more than one MTSO's, which comprise switches and communication devices, and govern a certain number of base stations. The communication devices of the MTSO are connected to the base stations.

A cellular wireless network is composed of several cells, and every cell has its own transmitting/receiving module (TRM), control channels (CC) and communication channels. The base station services one or more cells according to coverage requirements and with different antenna designs. The quantity, coverage regions, and frequency bands of the channels can be selected according to the service requirement of the cellular wireless network.

The mobile station is the mobile telephone mentioned above, which is a radio transceiver and a control unit for sending signals to the base station. When the mobile station intents to communicate with any other person, signals are transmitted to the MTSO via a wireless channel of the base station assigned to the mobile station, and then are forwarded to a public switched telephone network (PSTN). Every mobile station can receive and make a call from a subscribed MTSO, and also can make a call from other MTSO's by roaming. Besides, when a mobile station in use moves from one cell to another, the channel of the mobile station is automatically switched to that of the new cell.

From the above descriptions, when the base station services a larger quantity of mobile stations in a region such as a downtown area with a large population, the base station must have a larger capacity for dealing simultaneously with the higher communication load from many mobile stations. The mobile telephone network system applies a frequency reuse technique to increase the system capacity, and thus a large quantity of the base stations must be deployed.

Generally, the antenna used in the base station is a directional antenna, called a sector antenna, and the advantage of the antenna is that the energy of the antenna can be concentrated on a sector region. For the mobile telephone network system, the directional antenna is very helpful to the deployment of the base stations. However, in practice, the antenna radiation pattern of the sector antenna has an unwanted back lobe that radiates energy backward to other cells.

Since a cellular system adopts the above-mentioned frequency reuse technique, two signals of the same channel arriving at a mobile station from different base stations will interfere with each other. Thus, a larger back lobe of the base-station antenna radiation pattern will cause more interference to the service regions of other base stations. Also, the base-station antennas are usually mounted on top of buildings. Therefore, the back lobe radiations will more likely cause co-channel interferences to adjacent base stations assigned with the same frequencies.

In the prior art, in order to prevent mobile stations from co-channel interferences between different base stations and the communication quality thereof from being affected, the usual solution is to increase the distances between base stations using the same channels. However, this solution reduces the quantity of base stations in a certain area, and decreases the signal strengths over some regions in the certain area. Also, if the base-station antenna is mounted on top of a building, a conventional approach for reducing the co-channel interferences is to place a metal-grid panel behind the base-station antenna to shield the back-lobe radiation. However, this conventional method would affect the outer appearance of the base station, increase the wind resistance of the base-station antenna, require higher cost, need more construction efforts, and yet only provide smaller improvement.

SUMMARY

Accordingly, the invention uses the electromagnetic scattering principle to design electromagnetic scattering structures configured on a radome of an antenna to improve the antenna radiation patterns. The material of the electromagnetic structure is conductive. According to the electromagnetic principles, when electromagnetic waves illuminate conductive materials, induced currents will be excited on the conductive materials. Therefore, currents will be induced on the electromagnetic scattering structures due to the electromagnetic waves from the base-station antenna, and the induced currents then generate secondary radiation electromagnetic waves. The secondary radiation electromagnetic waves will interfere with the electromagnetic waves from the base-station antenna, and thus improve the antenna radiation patterns of the base station.

It is therefore an objective of the present invention to provide a method for improving antenna radiation patterns, which effectively reduces the back lobe of the antenna radiation patterns, to decrease the energy radiating to areas not covered by the base station, and mitigate interferences between adjacent base stations.

It is another objective of the present invention to provide a method for improving antenna radiation patterns in the horizontal plane, of which the energy outside the service region is reduced to mitigate the co-channel interferences or the adjacent-channel Interferences between the base stations. Or, the service region is increased to enlarge the coverage area of the base station.

It is still another objective of the present invention to provide a method for improving antenna radiation patterns in the vertical plane, of which the down-tilted angle of the main lobe is varied, so that the service of a base station is improved for the mobile stations positioned below.

It is still another objective of the present invention to provide an electromagnetic scattering structure, which is configured on a radome of the base station to adjust easily the antenna radiation patterns without any change of the size of the base-station antenna. Thus, one may replace the metal-grid panel, which is more expensive, hard to construct, and only a smaller improvement.

It is still another objective of the present invention to provide a radome with different functions for mobile communication system operators to choose according to requirements in different areas, so as to reduce the energy in regions not covered by the base station, and enlarge the coverage area of the base-station antenna or enhance the energy radiating downward from a base station on top of a building to the mobile stations positioned below.

In accordance with the foregoing and other objectives of the present invention, method and apparatus for improving antenna radiation patterns are provided. The electromagnetic scattering structure has a conductive layer with certain patterns, and is applied on the radome of the base-station antenna. The electromagnetic waves radiating from the antenna therein induce scattering effects, which, together with the electromagnetic diffractions from the rear metal panel of the antenna, can substantially reduce the back lobe and the fields in regions not covered by the antenna. Thus, the antenna radiation patterns are improved.

In the electromagnetic scattering structure of the present invention, the pattern of the conductive layer is designed according to a central working frequency of the antenna, and has variations of patterns and arrangements according to different demands. The units of the pattern, whether the type thereof is single or mixed, have a variety of modifications in their sizes, arrangements or quantities, and the purpose thereof is to improve the antenna radiation patterns. For example, the electromagnetic scattering structures, which comprises units of the same type but with different lengths, can adjust the antenna radiation pattern in the horizontal plane to change the level of the back lobe, the half-power beam width of the main lobe, or the energy radiating to certain directions from the base station.

According to preferred embodiments of the invention, the material of the conductive layer is metal, such as copper, and an adhesive layer is configured between the patterned conductive layer and a shell of the radome to stick the patterned conductive layer on the shell. Moreover, the present invention further comprises a protective layer, which is configured on one side of the patterned conductive layer opposite to the shell, to protect the patterned conductive layer. In addition, the patterned conductive layer is configured on an inner wall or an outer wall of the shell.

The pattern of the conductive layer comprises a plurality of units, such as strip units, cross units, U-shaped units, meandered square units or their combinations. The length of one of these units is a half, an integer multiple, or a certain multiple of a corresponding wavelength at the central working frequency of the antenna.

According to another preferred embodiment of the present invention, the patterned conductive layer is directly embedded in the shell, and the shell of the radome is therefore used to protect the conductive layer.

According to another preferred embodiment of the present invention, the pattern of the conductive layer comprises a plurality of slot units, such as spiral slot units. The slot units are a plurality of openings of the conductive layer, i.e. the slots of the conductive layer. The electromagnetic waves are scattered when they are transmitted through the discontinuous place, such as the interface between the conductive layer and the openings of this preferred embodiment. Therefore, the slot unit of the opening type can also be used in the present invention to form the pattern.

The embodiments of the invention provide several patterns for the conductive layer. Most can suppress the electromagnetic diffractions from the rear metal panel of the antenna, such that the energy radiating backward is reduced. The application of the same type but with different lengths can adjust the antenna radiation pattern in the horizontal plane to change the level of the back lobe, the half-power beam width of the main lobe and the energy radiating to certain directions from the base station. In addition, the electromagnetic scattering structures comprising different units can decrease the energy radiating to areas not covered by the base station, as well as decreasing the back lobe of the antenna radiation pattern.

In conclusions, the invention can decrease the energy radiating to areas not covered by the base station, and increase the energy radiating to the service regions of the base station or change the direction of the radiation of the antenna. Therefore, besides decreasing the cost of installing more base stations, the inventions further allow the energy of the antenna radiate more effectively to the coverage area. Moreover, the application of the invention is easy and convenient, and performs well, thus providing an economic and practical method and apparatus.

It is to be understood that both the foregoing general description and the following detailed description are examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings, where:

DESCRIPTION OF THE PREFERRED EMBODIMENTS

Figure 1:
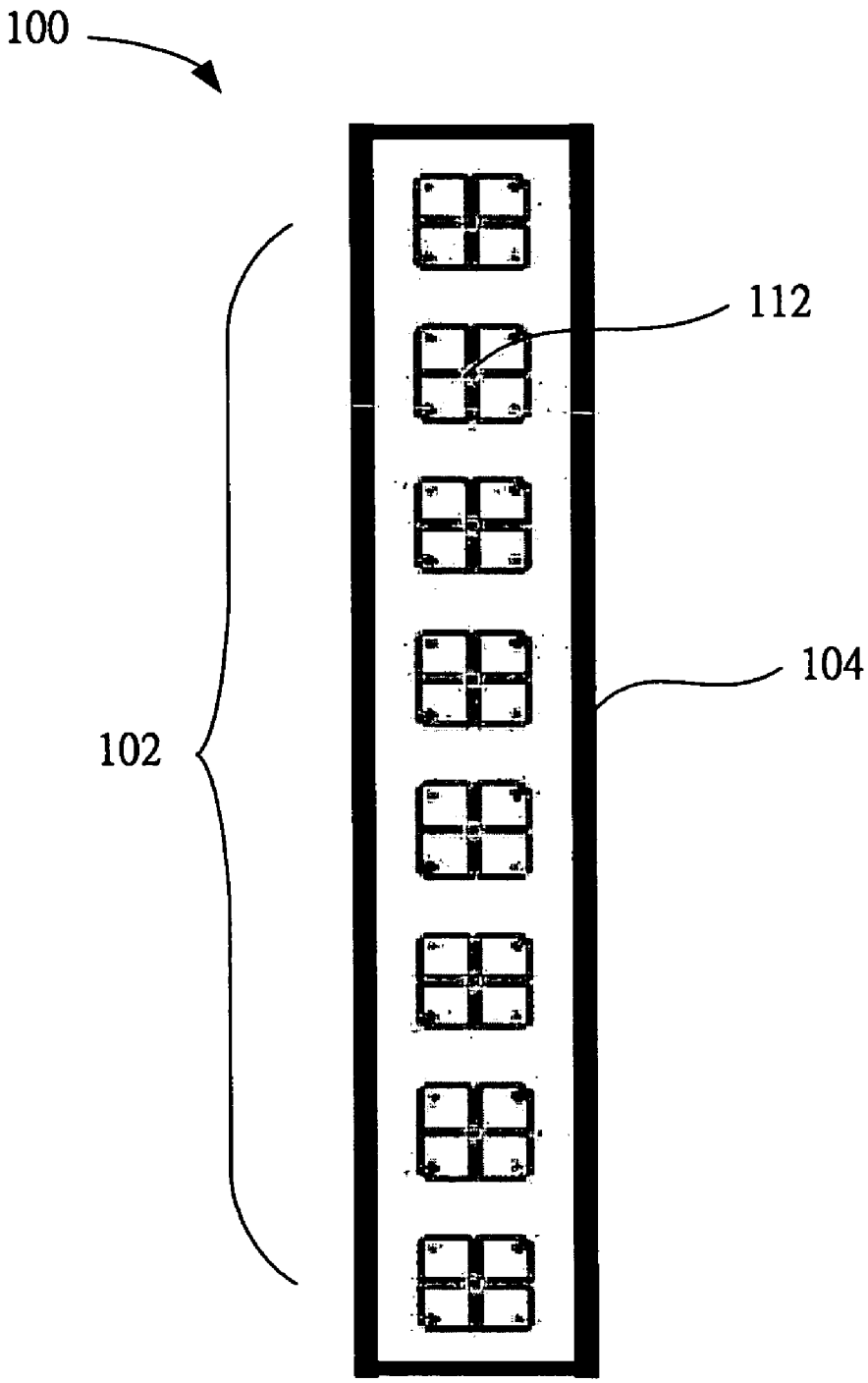
FIG. 1 (PRIOR ART)
FIG. 1 illustrates a front view of the base-station antenna.

Reference will now be made in detail to the present preferred embodiments of the invention, examples of which are illustrated in the accompanying drawings. Wherever possible, the same reference numbers are used in the drawings and the description to refer to the same or like parts.

The following descriptions use a base-station antenna for third generation mobile communications to be an example for illustrating several embodiments of the present invention. As illustrated in FIG. 1, a base-station antenna 100 comprises an array antenna 102 and a radome 104. The array antenna 102 comprises a plurality of antenna units 112, and the antenna units are enclosed in the radome 104. The base-station antenna 100 is a sector antenna, of which the central working frequency is about 2 GHz. The electromagnetic wavelength corresponding to the central working frequency is about 150 mm. The length of the radome 104 is 1302 mm, the width thereof is 155 mm, the depth thereof is 69 mm and the thickness thereof is 2 mm. The relative dielectric constant of the material of the radome 104 is 2.73. Under these conditions, the characteristics of the antenna radiation patterns for the base-station antenna 100 are: the half-power beam width of the main lobe in the horizontal plane ($\theta$=90°): 64°; the half-power beam width of the main lobe in the vertical plane ($\phi$=0°): 6.5°; the front-to-back ratio: 26 dB; and the first side lobe level: −13.7 dB.

The electromagnetic scattering structure of the present invention comprises a patterned conductive layer, which is configured on the radome 104 in FIG. 1, and, more particularly, on the shell of the radome 104. For example, the conductive layer can be adhered on an inner wall or an outer wall of the radome 104 by an adhesive layer. Moreover, the present invention further comprises a protective layer, which is configured on one side of the patterned. conductive layer opposite to the shell, to protect the patterned conductive layer. According to another preferred embodiment of the present invention, the patterned conductive layer also can be directly embedded in the shell, and the shell of the radome is therefore used to protect the conductive layer.

In the following embodiments, the material of the conductive layer is metal, such as copper or other conductive metals.

The First Embodiment

Figure 2A:
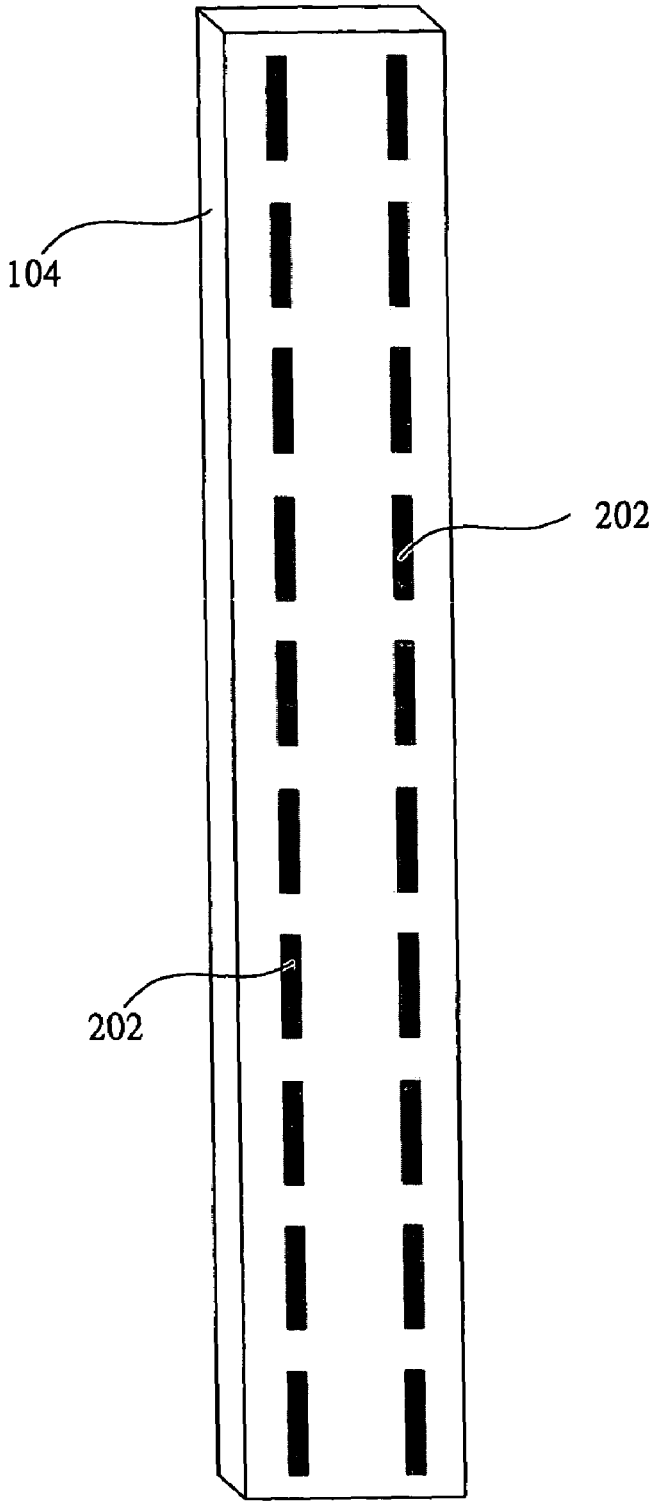
FIG. 2A illustrates a schematic view of the first embodiment of the present invention.

FIG. 2A illustrates a schematic view of the first embodiment of the present invention. In this embodiment, the electromagnetic scattering structure comprises a plurality of strip units 202. The length of the strip unit 202 is half of the corresponding wavelength at the central working frequency, which is about 76 mm, and the width of the strip unit 202, which is not critical, is 2 mm in this embodiment. The strip units 202 are arranged periodically in two rows and in front of the antenna inside the radome 104 (i.e. the array antenna 102 as illustrated in FIG. 1). The two rows are configured on the surface of the radome 104, and each is spaced a quarter wavelengths from each closer edge of the radome 104.

Figure 2B:
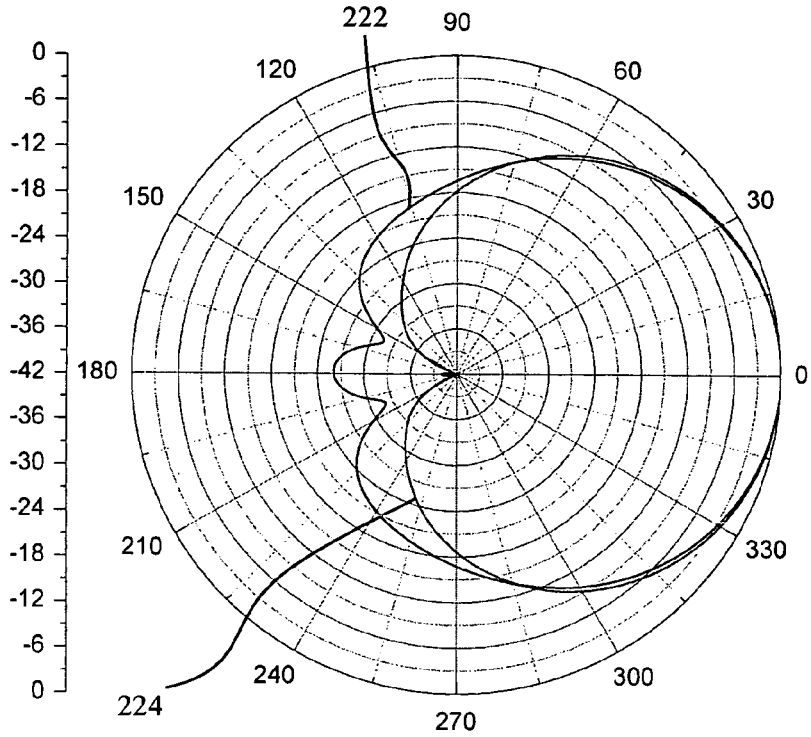
FIG. 2B illustrates a far-field antenna radiation pattern in the horizontal plane of the first embodiment.
Figure 2C:
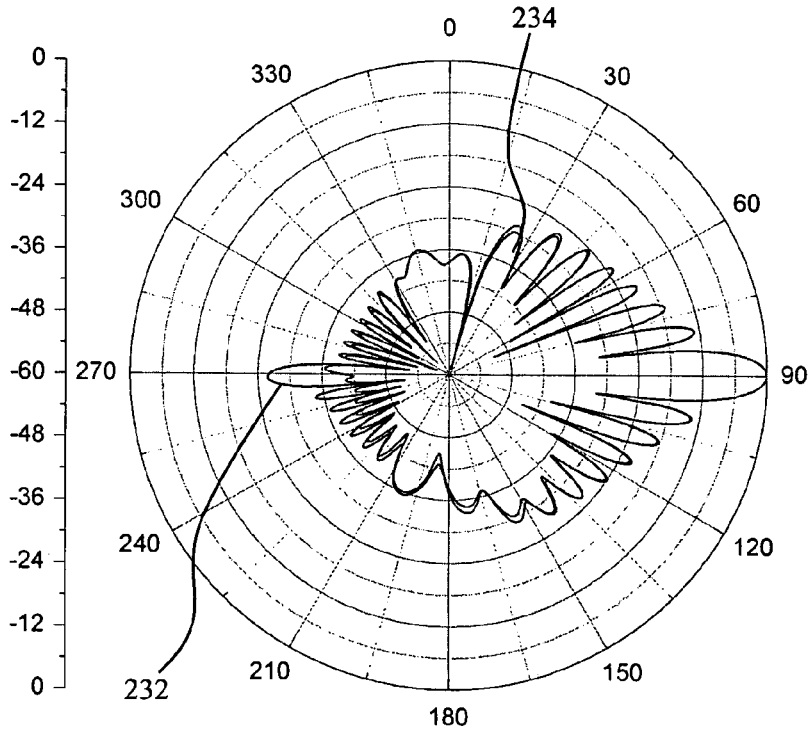
FIG. 2C illustrates a far-field antenna radiation pattern in the vertical plane of the first embodiment.

FIG. 2B illustrates far-field antenna radiation patterns in the horizontal plane of the first embodiment, and the radial axis thereof represents the relative field value in dB. The curve 222 is the antenna radiation pattern without the electromagnetic scattering structure of the embodiment, and the curve 224 is the antenna radiation pattern with the electromagnetic scattering structure. FIG. 2C illustrates far-field antenna radiation patterns in the vertical plane of the first embodiment, and the radial axis thereof represents the relative field value in dB. The curve 232 is the antenna radiation pattern without the electromagnetic scattering structure of the embodiment, and the curve 234 is the antenna radiation pattern with the electromagnetic scattering structure.

From FIGS. 2B and 2C, the level of the back lobe of the embodiment is about 14 dB lower than that of the antenna radiation pattern without the electromagnetic scattering structure, and the front-to-back ratio is increased to about 40 dB. In addition, the half-power beam width of the main lobe is almost unchanged, while the fields in other angles of the horizontal plane are reduced significantly by applying the electromagnetic scattering structure; for example, the level at the azimuth 120° is 8 dB lower.

The Second Embodiment

Figure 3A:
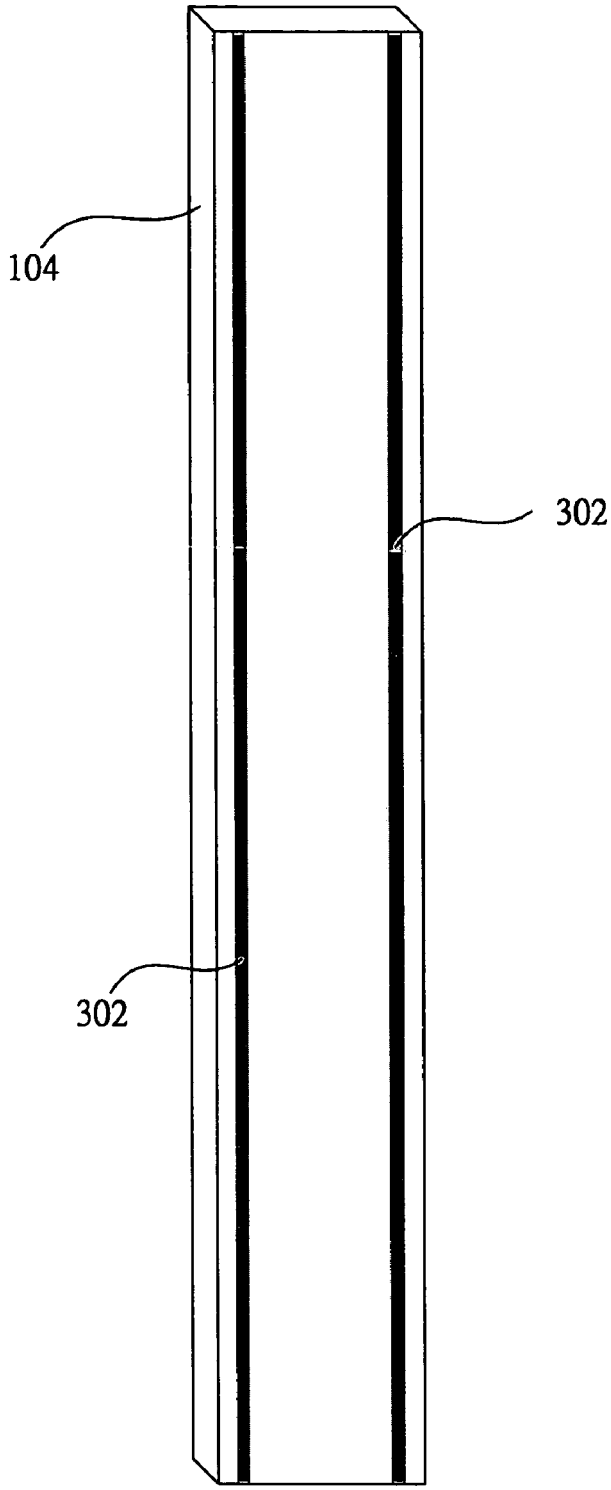
FIG. 3A illustrates a schematic view of the second embodiment of the present invention.

FIG. 3A illustrates a schematic view of the second embodiment of the present invention. In this embodiment, the electromagnetic scattering structure comprises two strip units 302. The length of the strip unit 302 is the same as the length of the radome 104, and the width of the strip unit 302, which is not critical, is 2 mm in this embodiment. The two strip units 302 are in front of the antenna inside the radome 104 (i.e. the array antenna 102 as illustrated in FIG. 1), and are configured on the surface of the radome 104

Figure 3B:
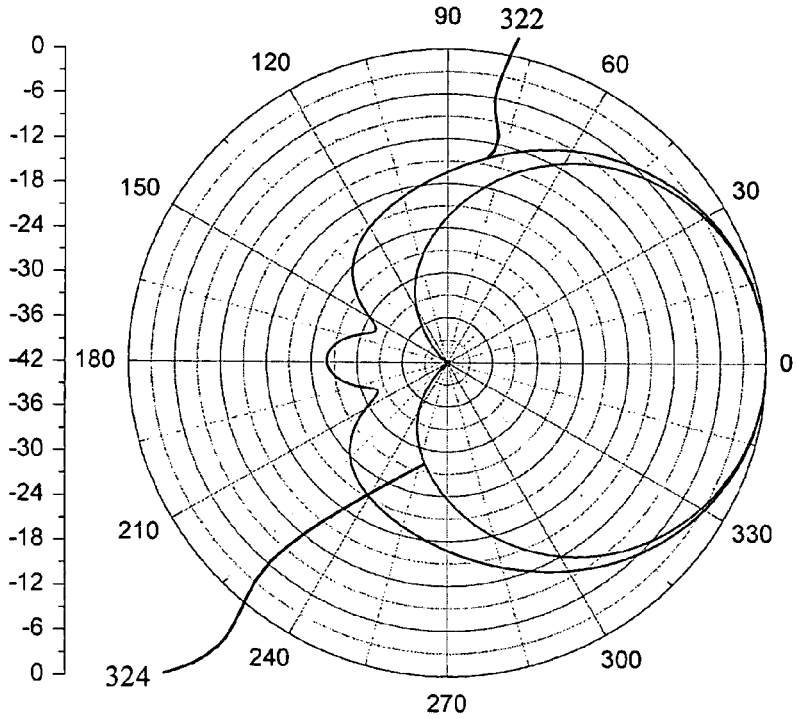
FIG. 3B illustrates a far-field antenna radiation pattern in the horizontal plane of the second embodiment.
Figure 3C:
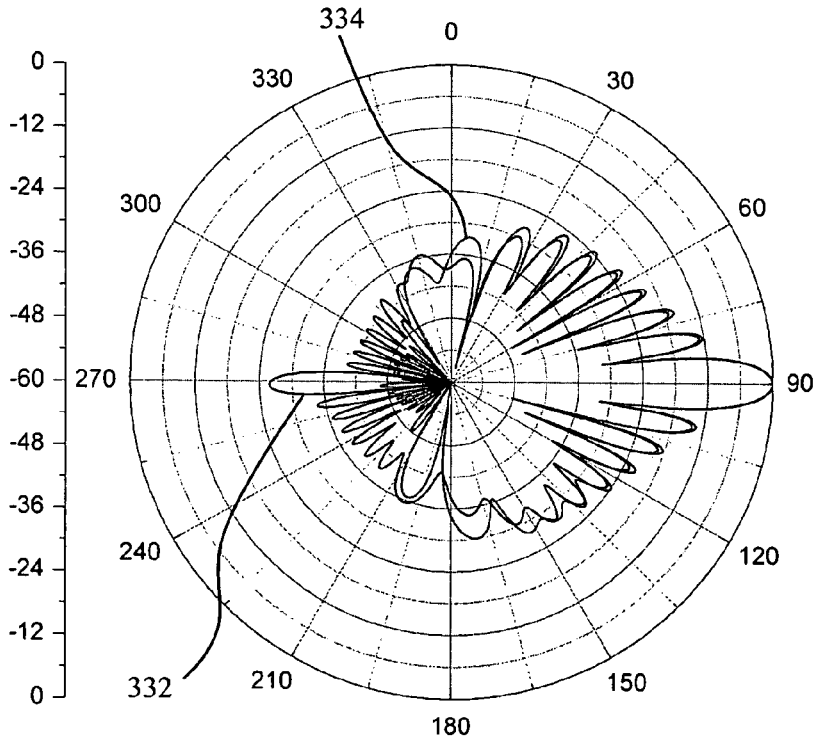
FIG. 3C illustrates a far-field antenna radiation pattern in the vertical plane of the second embodiment.

FIG. 3B illustrates far-field antenna radiation patterns in the horizontal plane of the second embodiment, and the radial axis thereof represents the relative field value in dB. The curve 322 is the antenna radiation pattern without the electromagnetic scattering structure of the embodiment, and the curve 324 is the antenna radiation pattern of the antenna with the electromagnetic scattering structure. FIG. 3C illustrates far-field antenna radiation patterns in the vertical plane of the second embodiment, and the radial axis thereof represents the relative field value in dB. The curve 332 is the antenna radiation pattern without the electromagnetic scattering structure of the embodiment, and the curve 334 is the antenna radiation pattern of the antenna with the electromagnetic scattering structure.

From FIGS. 3B and 3C, the level of the back lobe of the embodiment is about 34 dB lower than that of the antenna radiation pattern without the electromagnetic scattering structure, and the front-to-back ratio is increased to about 60 dB. In addition, the half-power beam width of the main lobe is almost unchanged, while the fields in other angles of the horizontal plane are reduced significantly by applying the electromagnetic scattering structure; for example, the level at the azimuth 120° is 13 dB lower. Therefore, the embodiment decreases the energy radiating to areas not covered by the base-station antenna so that interferences between adjacent base stations can be mitigated.

The Third Embodiment

Figure 4A:
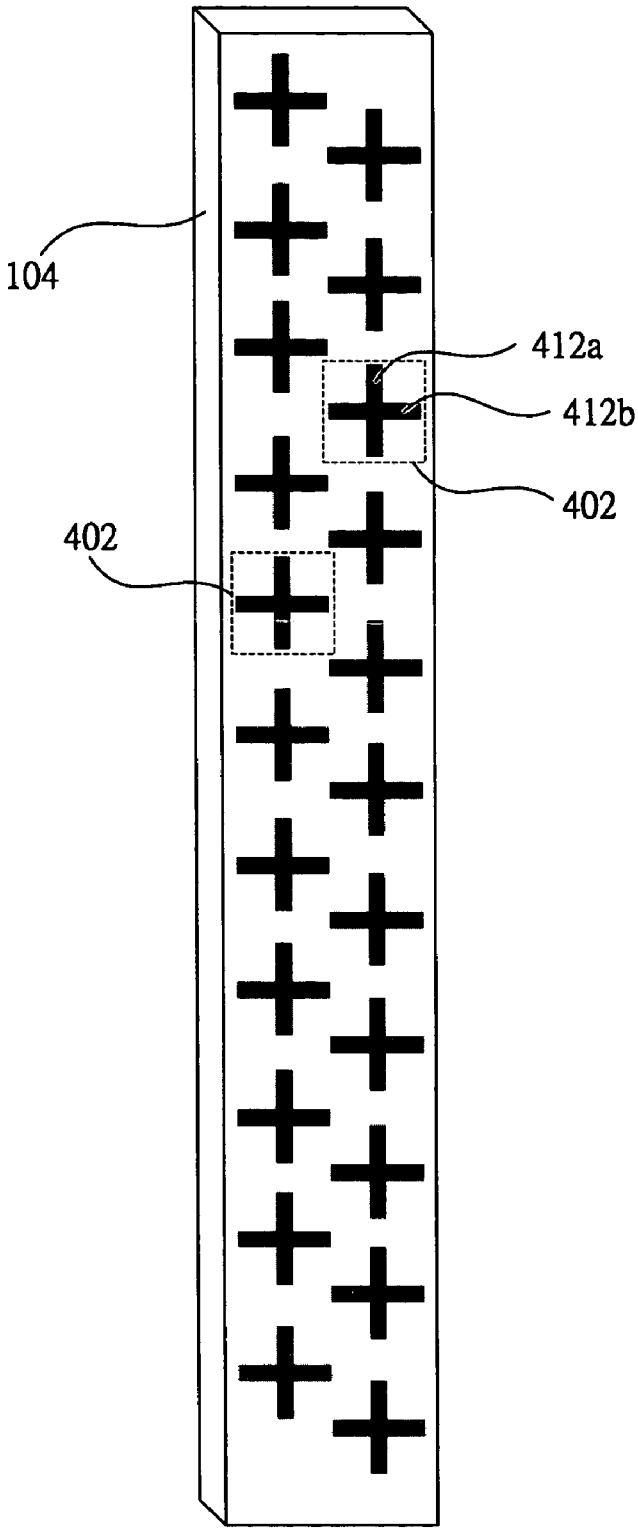
FIG. 4A illustrates a schematic view of the third embodiment of the present invention.

FIG. 4A illustrates a schematic view of the third embodiment of the present invention. In this embodiment, the electromagnetic scattering structure comprises a plurality of cross units 402. Each of the cross units 402 has two strip portions 412*a* and 412*b* with identical lengths. The length of the strip portions 412*a* and 412*b* is a half the corresponding wavelength at the central working frequency, and the widths of the strip portions 412*a* and 412*b*, which are not critical, are both 2 mm in this embodiment. The cross units 402 are in front of the antenna inside the radome 104 (i.e. the array antenna 102 as illustrated in FIG. 1), and are configured in two rows interleaving on the surface of the radome 104.

Figure 4B:
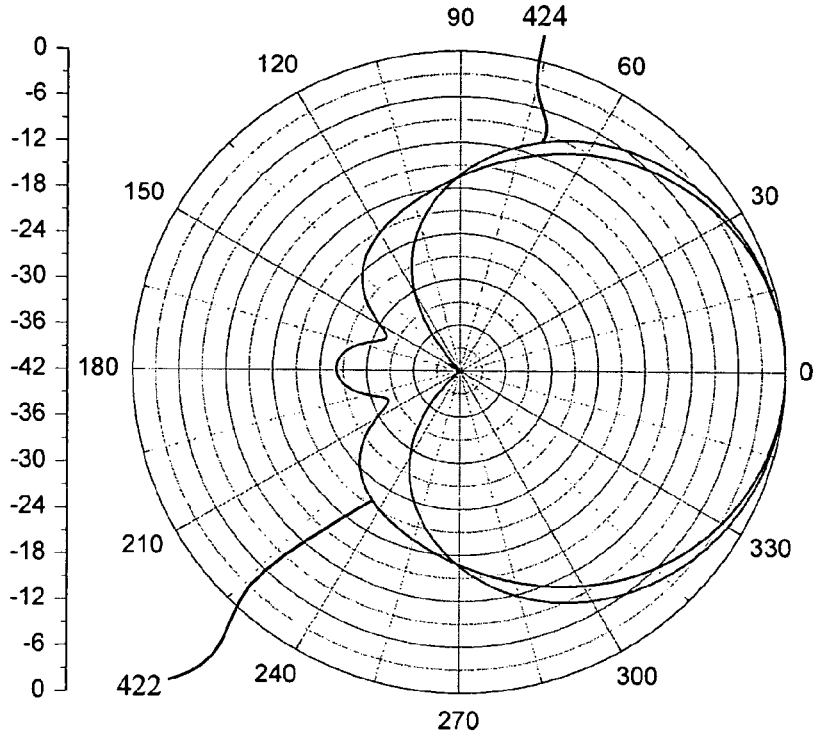
FIG. 4B illustrates a far-field antenna radiation pattern in the horizontal plane of the third embodiment.
Figure 4C:
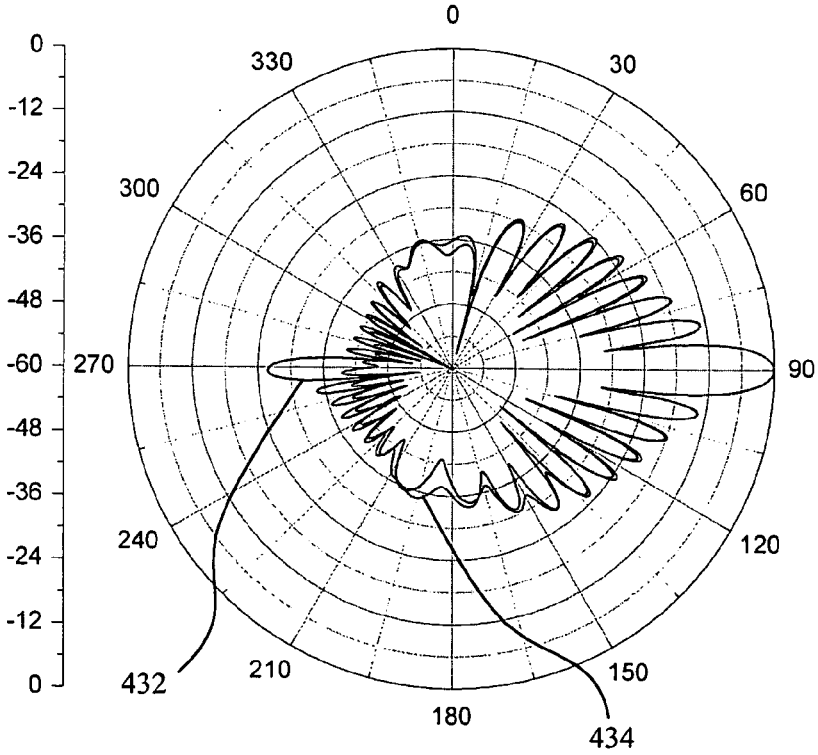
FIG. 4C illustrates a far-field antenna radiation pattern in the vertical plane of the third embodiment.

FIG. 4B illustrates far-field antenna radiation patterns in the horizontal plane of the third embodiment, and the radial axis thereof represents the relative field value in dB. The curve 422 is the antenna radiation pattern without the electromagnetic scattering structure of the embodiment, and the curve 424 is the antenna radiation pattern of the antenna with the electromagnetic scattering structure. FIG. 4C illustrates far-field antenna radiation patterns in the vertical plane of the third embodiment, and the radial axis thereof represents the relative field value in dB. The curve 432 is the antenna radiation pattern without the electromagnetic scattering structure of the embodiment, and the curve 434 is the antenna radiation pattern of the antenna with the electromagnetic scattering structure.

From FIGS. 4B and 4C, the level of the back lobe of the embodiment is about 18 dB lower than that of the antenna radiation pattern without the electromagnetic scattering structure, and the front-to-back ratio is increased to about 44.5 dB. Therefore, the embodiment effectively reduces the energy radiating backward; the half-power beam width of the main lobe in the horizontal plane becomes 75°, and thus the coverage sector is increased by 11° more than the antenna radiation pattern without the electromagnetic scattering structure.

The Fourth Embodiment

Figure 5A:
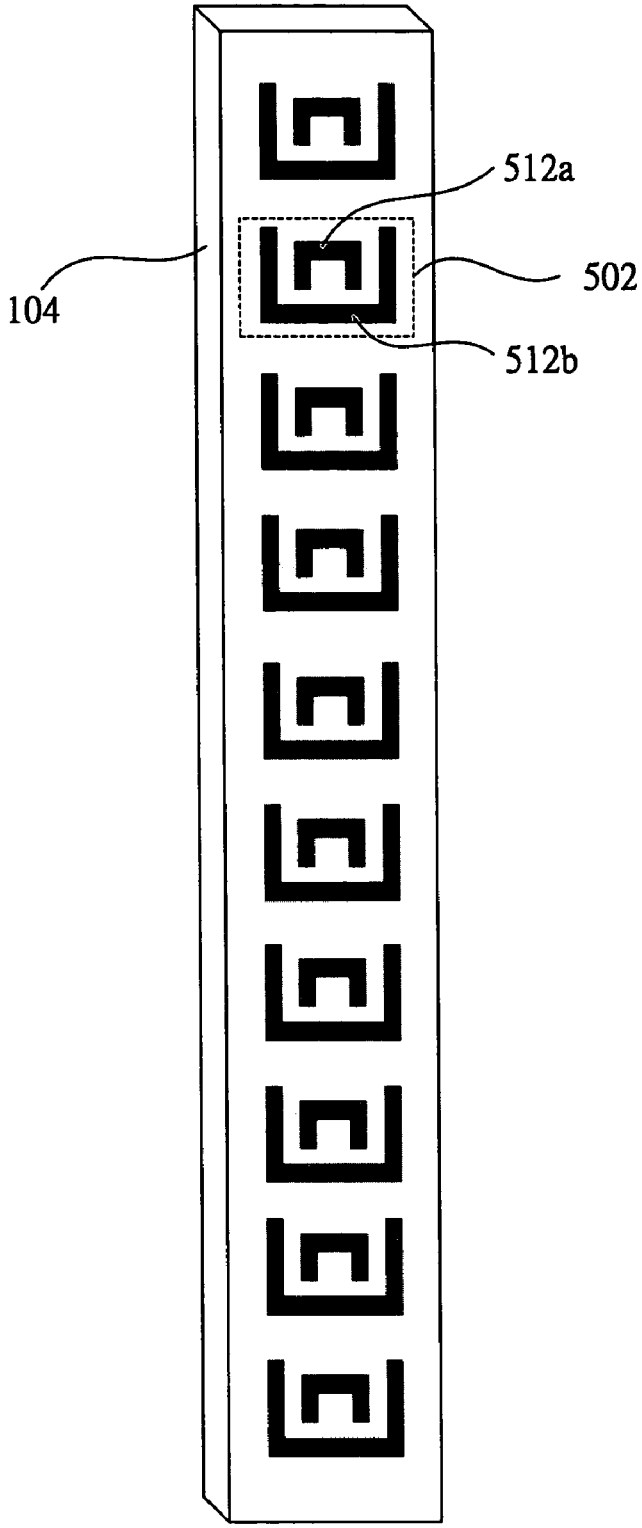
FIG. 5A illustrates a schematic view of the fourth embodiment of the present invention.

FIG. 5A illustrates a schematic view of the fourth embodiment of the present invention. In this embodiment, the electromagnetic scattering structure comprises a plurality of U-shaped combinations 502. Each of the U-shaped combinations 502 has a first U-shaped unit 512*a* and a second U-shaped unit 512*b*, which are placed opposite to each other. The length of the first U-shaped unit 512*a* is equal to the corresponding wavelength at the central working frequency, and the length of the second U-shaped unit 512*b* is two times the corresponding wavelength at the central working frequency. The widths of the two U-shaped units 512*a* and 512*b*, which are not critical, are both 2 mm in this embodiment. The U-shaped combinations 502 are arranged in a row and in front of the antenna inside the radome 104 (i.e. the array antenna 102 as illustrated in FIG. 1).

Figure 5B:
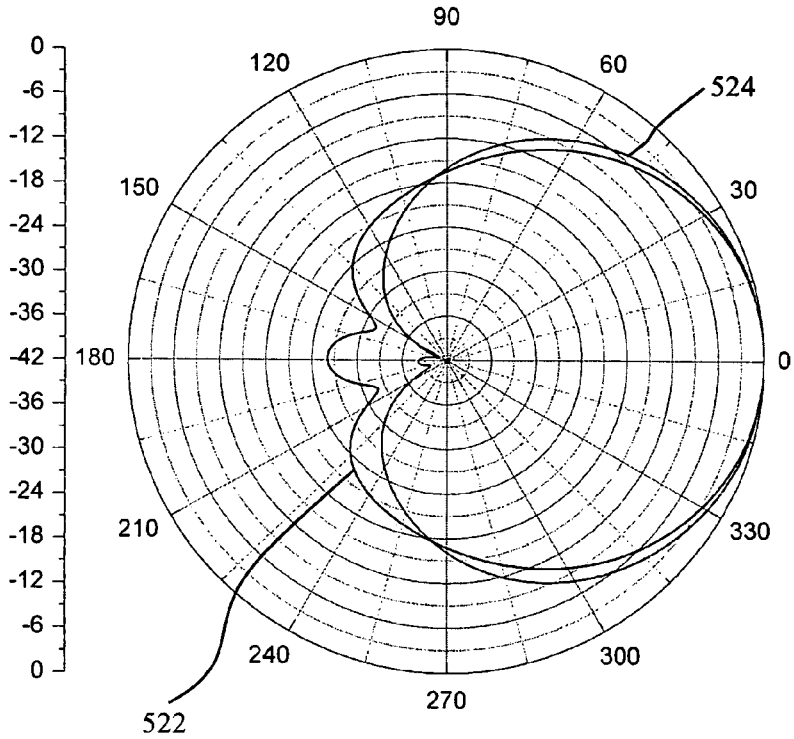
FIG. 5B illustrates a far-field antenna radiation pattern in the horizontal plane of the fourth embodiment.
Figure 5C:
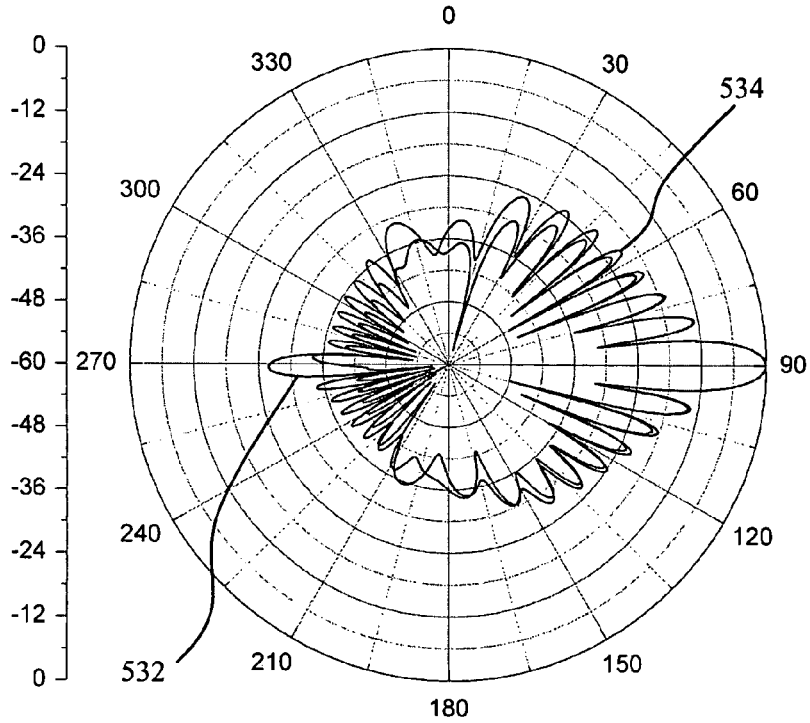
FIG. 5C illustrates a far-field antenna radiation pattern in the vertical plane of the fourth embodiment.

FIG. 5B illustrates far-field antenna radiation patterns in the horizontal plane of the fourth embodiment, and the radial axis thereof represents the relative field value in dB. The curve 522 is the antenna radiation pattern without the electromagnetic scattering structure of the embodiment, and the curve 524 is the antenna radiation pattern of the antenna with the electromagnetic scattering structure. FIG. 5C illustrates far-field antenna radiation patterns in the vertical plane of the fourth embodiment, and the radial axis thereof represents the relative field value in dB. The curve 532 is the antenna radiation pattern without the electromagnetic scattering structure of the embodiment, and the curve 534 is the antenna radiation pattern of the antenna with the electromagnetic scattering structure.

From FIGS. 5B and 5C, the level of the back lobe of the embodiment is about 8 dB lower than that of the antenna radiation pattern without the electromagnetic scattering structure, and the front-to-back ratio is increased to about 34 dB.

The Fifth Embodiment

Figure 6A:
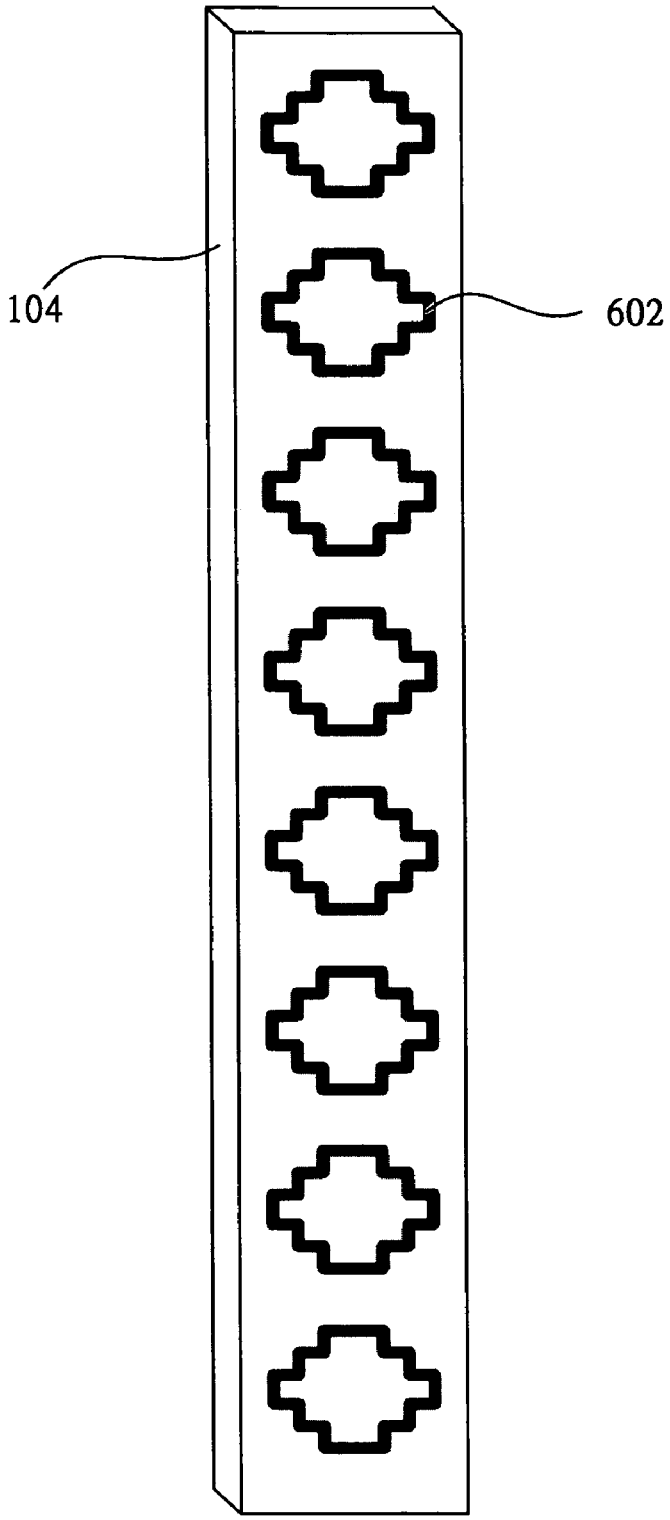
FIG. 6A illustrates a schematic view of the fifth embodiment of the present invention.

FIG. 6A illustrates a schematic view of the fifth embodiment of the present invention. In this embodiment, the electromagnetic scattering structure comprises a plurality of meandered square units 602. The circumference of each of the meandered square units 602 is an integer multiple of the corresponding wavelength at the central working frequency. The width of the meandered square unit 602, which is not critical, is 6 mm in this embodiment. The meandered square units are arranged in a row and in front of the antenna inside the radome 104 (i.e. the array antenna 102 as illustrated in FIG. 1).

Figure 6B:
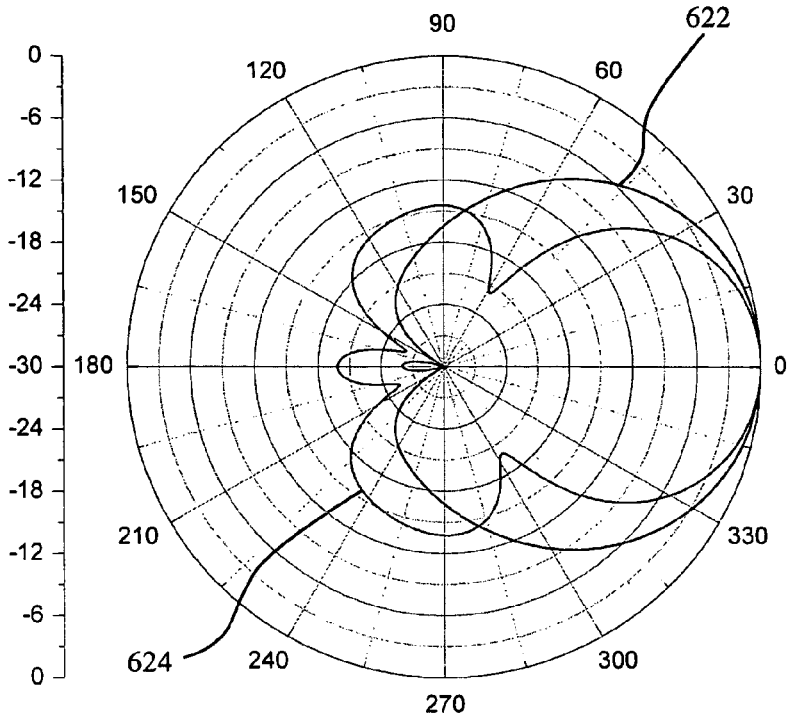
FIG. 6B illustrates a far-field antenna radiation pattern in the horizontal plane of the fifth embodiment.
Figure 6C:
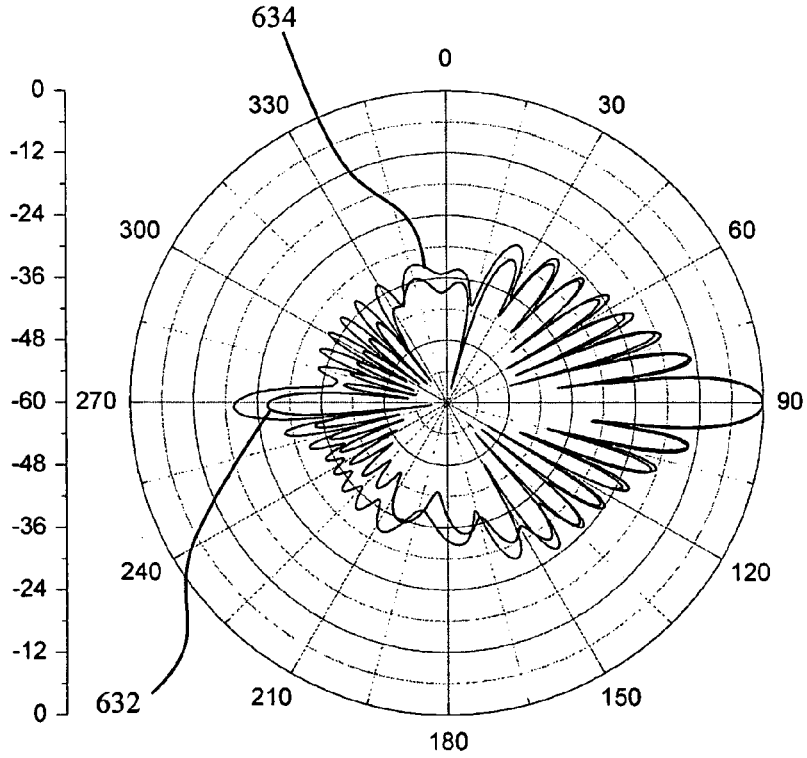
FIG. 6C illustrates a far-field antenna radiation pattern in the vertical plane of the fifth embodiment.

FIG. 6B illustrates far-field antenna radiation patterns in the horizontal plane of the fifth embodiment, and the radial axis thereof represents the relative field value in dB. The curve 622 is the antenna radiation pattern without the electromagnetic scattering structure of the embodiment, and the curve 624 is the antenna radiation pattern of the antenna with the electromagnetic scattering structure. FIG. 6C illustrates far-field antenna radiation patterns in the vertical plane of the fifth embodiment, and the radial axis thereof represents the relative field value in dB. The curve 632 is the antenna radiation pattern without the electromagnetic scattering structure of the embodiment, and the curve 634 is the antenna radiation pattern of the antenna with the electromagnetic scattering structure.

From FIGS. 6B and 6C, the level of the back lobe of the embodiment is about 6.2 dB higher than that of the antenna radiation pattern without the electromagnetic scattering structure, and the front-to-back ratio is reduced to about 19.8 dB. Although the level of the back lobe of the antenna radiation pattern with the electromagnetic scattering structure is higher than that of the antenna radiation pattern without the electromagnetic scattering structure, the energies radiating in the azimuths 60° and 300° are about 12.2 dB less than those of the antenna radiation pattern without the electromagnetic scattering structure, and the half-power beam width of the main lobe is reduced to about 46.5°. Therefore, the embodiment reduces the coverage region of the antenna radiation pattern, and thus mitigates the interferences from or to the adjacent base stations in the directions around the azimuths 60° and 300°.

The Sixth Embodiment

Figure 7A:
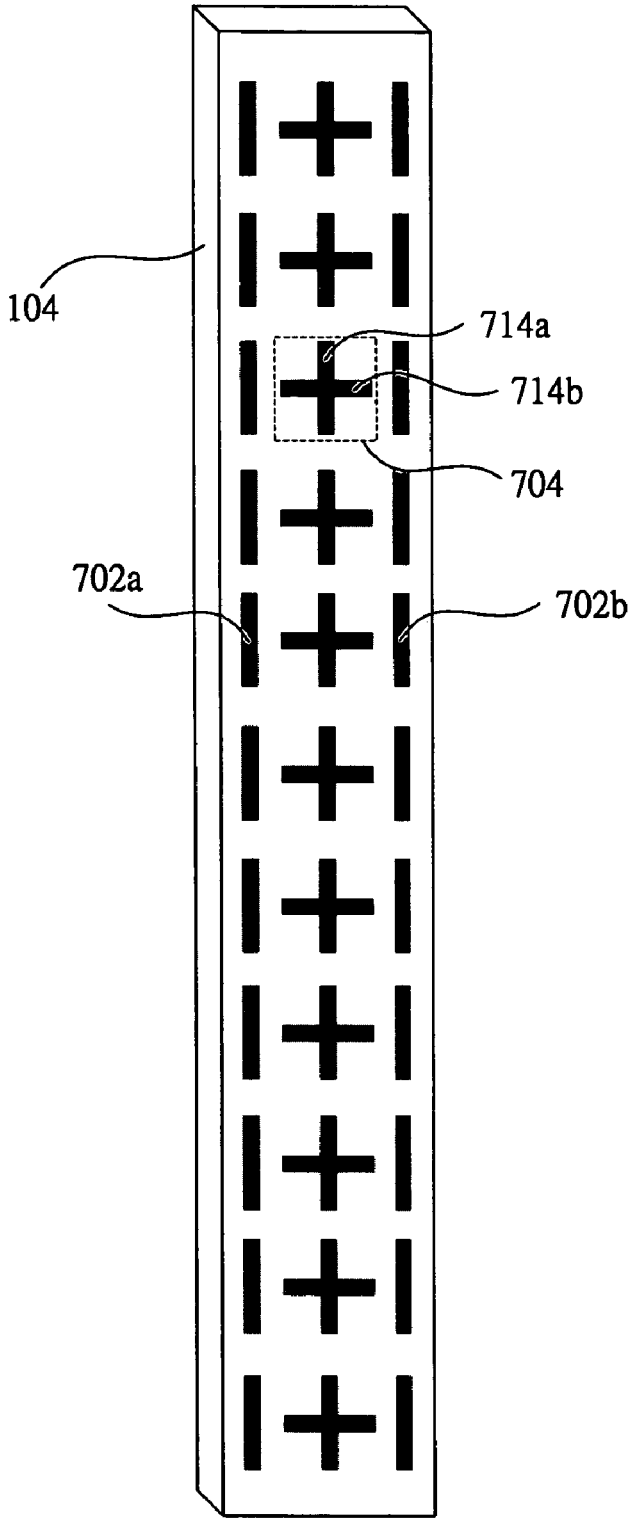
FIG. 7A illustrates a schematic view of the sixth embodiment of the present invention.

FIG. 7A illustrates a schematic view of the sixth embodiment of the present invention. In this embodiment, the electromagnetic scattering structure comprises a plurality of cross units 704 and a plurality of strip units 702*a* and 702*b*. Each of the cross units 704 has two strip portions 714*a* and 714*b* with identical lengths. The lengths of the strip portions 714*a* and 714*b* are both 0.45 times the corresponding wavelength at the central working frequency. The length of each of the strip units 702*a* and 702*b* is a half the corresponding wavelength at the central working frequency. The widths of the strip portions 714*a* and 714*b* and the strip units 702*a* and 702*b* are not critical. In this embodiment, the widths of the strip portions 714*a* and 714*b* are 8 mm, and the widths of the strip units 702*a* and 702*b* are 2 mm.

The cross units 704 and the strip units 702*a*, 702*b* are arranged in rows and in front of the antenna inside the radome 104 (i.e. the array antenna 102 as illustrated in FIG. 1). Moreover, the rows of the strip units 702*a* and 702*b* are configured separately on the two sides of the radome 104, and each of the cross units 704 is placed between two corresponding strip units 702*a* and 702*b*.

Figure 7B:
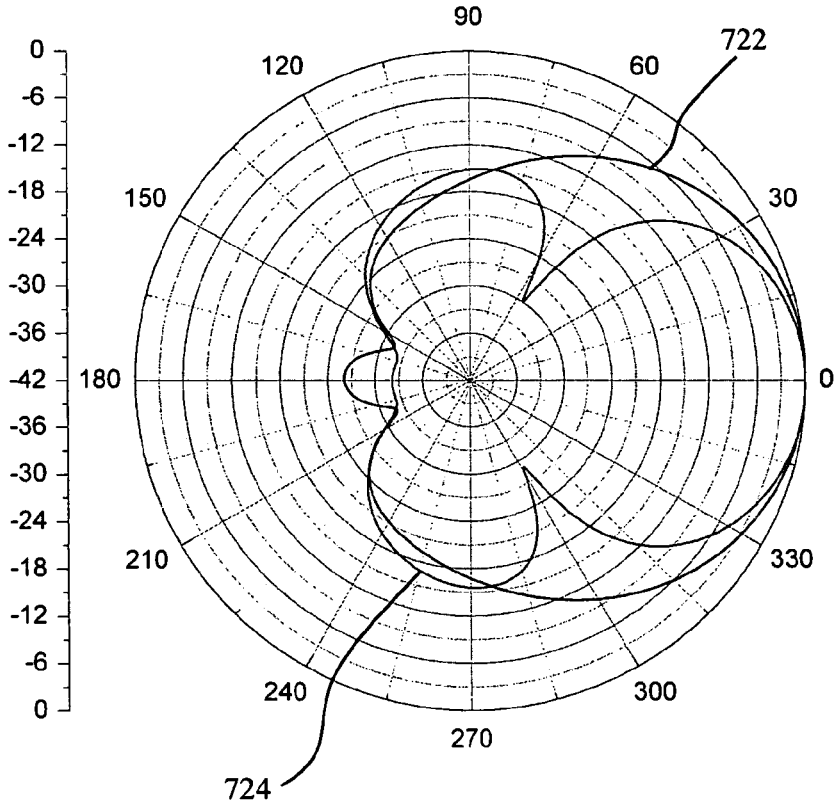
FIG. 7B illustrates a far-field antenna radiation pattern in the horizontal plane of the sixth embodiment.
Figure 7C:
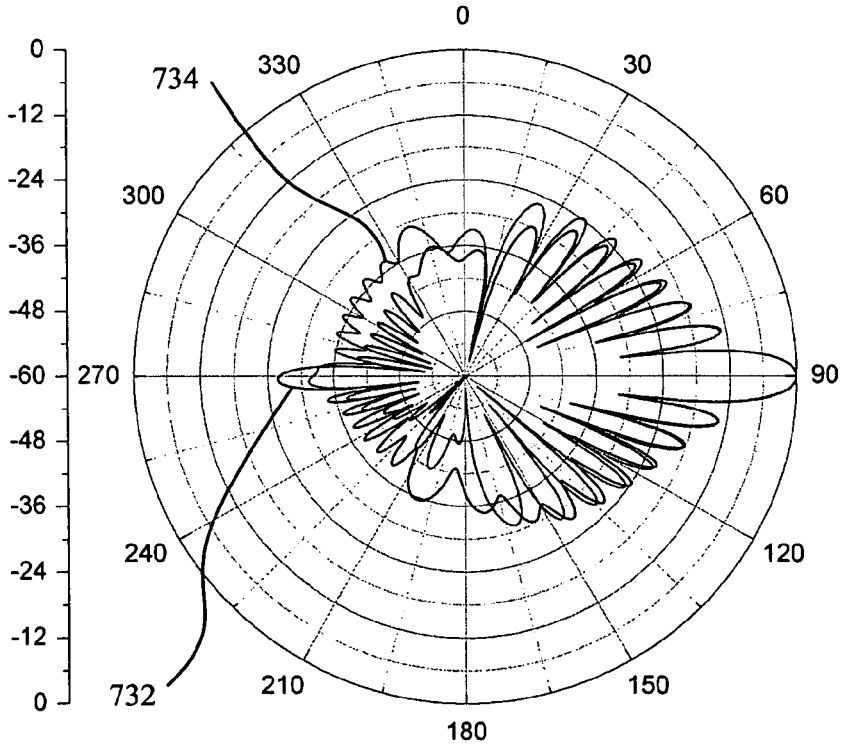
FIG. 7C illustrates a far-field antenna radiation pattern in the vertical plane of the sixth embodiment.

FIG. 7B illustrates far-field antenna radiation patterns in the horizontal plane of the sixth embodiment, and the radial axis thereof represents the relative field value in dB. The curve 722 is the antenna radiation pattern without the electromagnetic scattering structure of the embodiment, and the curve 724 is the antenna radiation pattern of the antenna with the electromagnetic scattering structure. FIG. 7C illustrates far-field antenna radiation patterns in the vertical plane of the sixth embodiment, and the radial axis thereof represents the relative field value in dB. The curve 732 is the antenna radiation pattern without the electromagnetic scattering structure of the embodiment, and the curve 734 is the antenna radiation pattern of the antenna with the electromagnetic scattering structure.

From FIGS. 7B and 7C, the level of the back lobe of the embodiment is about 6 dB lower than that of the antenna radiation pattern without the electromagnetic scattering structure, and the front-to-back ratio is increased to about 32 dB. Besides, the energies radiating in the azimuths 60° and 300° are about 18.4 dB less than those of the antenna radiation pattern without the electromagnetic scattering structure, and the half-power beam width of the main lobe is reduced to about 46.5°.

The Seventh Embodiment

Figure 8A:
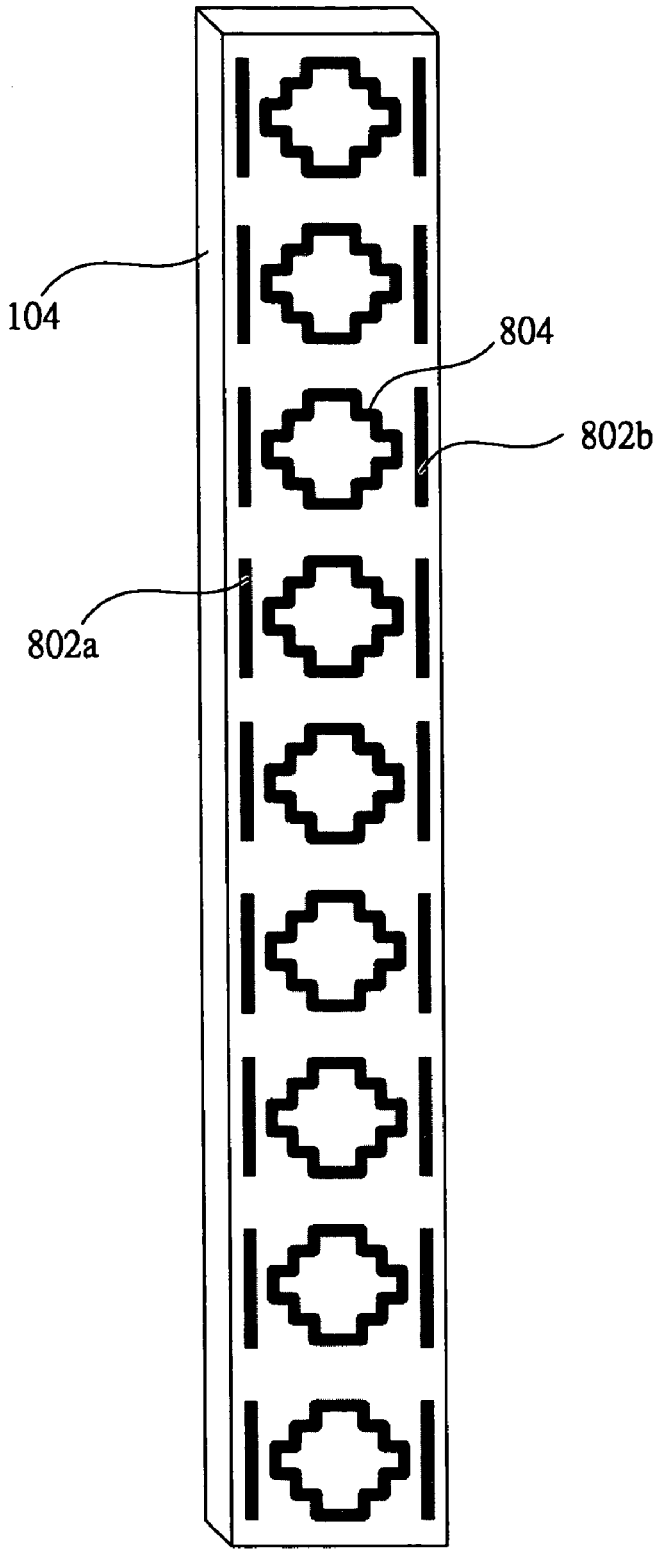
FIG. 8A illustrates a schematic view of the seventh embodiment of the present invention.

FIG. 8A illustrates a schematic view of the seventh embodiment of the present invention. In this embodiment, the electromagnetic scattering structure comprises a plurality of meandered square units 804 and a plurality of strip units 802*a* and 802*b*. The length of each of the strip units 802*a* and 802*b* is half of the corresponding wavelength at the central working frequency. The circumference of each of the meandered square units 804 is an integer multiple of the corresponding wavelength at the central working frequency. The widths of the strip units 802*a* and 802*b* and the meandered square units 804 are not critical. In this embodiment, the widths of the meandered square units 804 are 6 mm, and the widths of the strip units 802*a* and 802*b* are 2 mm.

The meandered square units 804, the strip units 802*a* and 802*b* are arranged in rows and in front of the antenna inside the radome 104 (i.e. the array antenna 102 as illustrated in FIG. 1). Moreover, the rows of the strip units 802*a* and 802*b* are configured separately on the two sides of the radome 104, and each of the meandered square units 804 is placed between two corresponding strip units 802*a* and 802*b*.

Figure 8B:
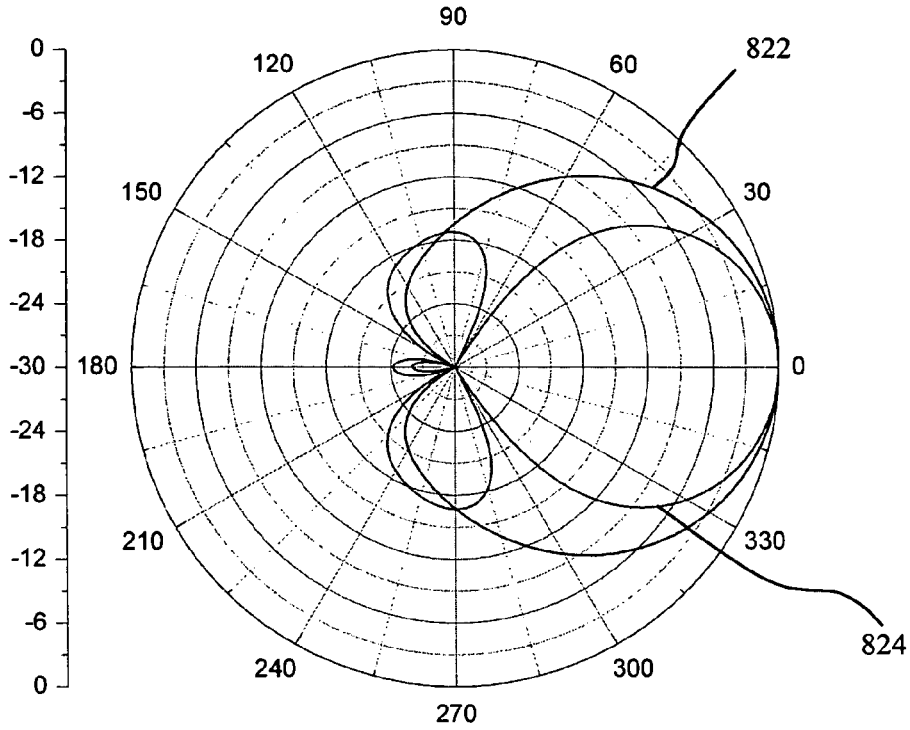
FIG. 8B illustrates a far-field antenna radiation pattern in the horizontal plane of the seventh embodiment.
Figure 8C:
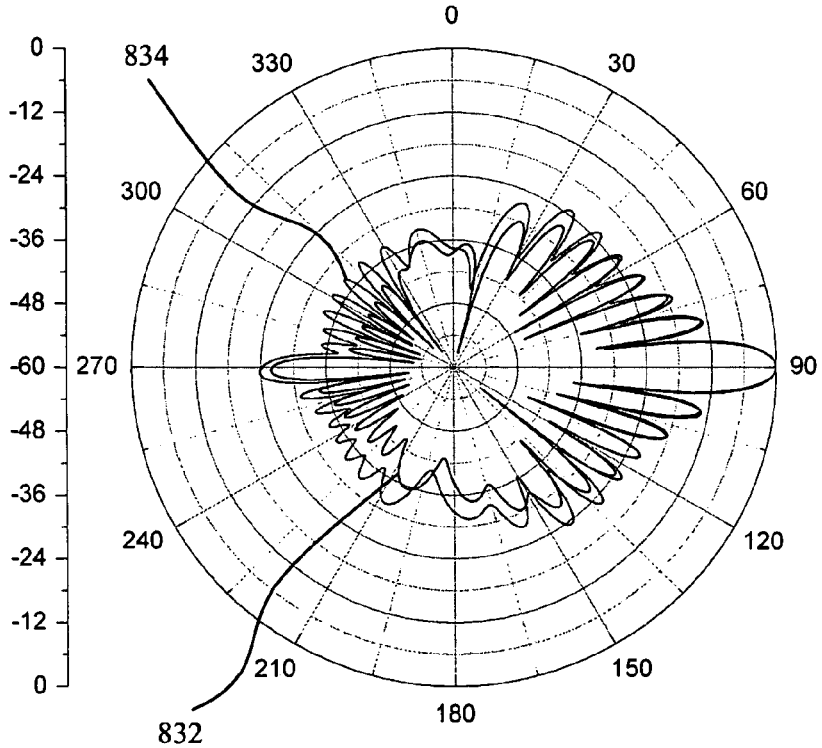
FIG. 8C illustrates a far-field antenna radiation pattern in the vertical plane of the seventh embodiment.

FIG. 8B illustrates far-field antenna radiation patterns in the horizontal plane of the seventh embodiment, and the radial axis thereof represents the relative field value in dB. The curve 822 is the antenna radiation pattern without the electromagnetic scattering structure of the embodiment, and the curve 824 is the antenna radiation pattern of the antenna with the electromagnetic scattering structure. FIG. 8C illustrates far-field antenna radiation patterns in the vertical plane of the seventh embodiment, and the radial axis thereof represents the relative field value in dB. The curve 832 is the antenna radiation pattern without the electromagnetic scattering structure of the embodiment, and the curve 834 is the antenna radiation pattern of the antenna with the electromagnetic scattering structure.

From FIGS. 8B and 8C, the level of the back lobe of the embodiment is only increased by about 1.8 dB compared with that of the antenna radiation pattern without the electromagnetic scattering structure, and the front-to-back ratio is reduced to about 24.2 dB. The energies radiating in the azimuths 60° and 300° are about 38 dB less than those of the antenna radiation pattern without the electromagnetic scattering structure, and the half-power beam width of the main lobe is reduced to about 46.5°. Therefore, the embodiment reduces the coverage region of the antenna radiation pattern, and thus mitigates the interferences from or to the adjacent base stations in the directions around the azimuths 60° and 300°.

The Eighth Embodiment

Figure 9A:
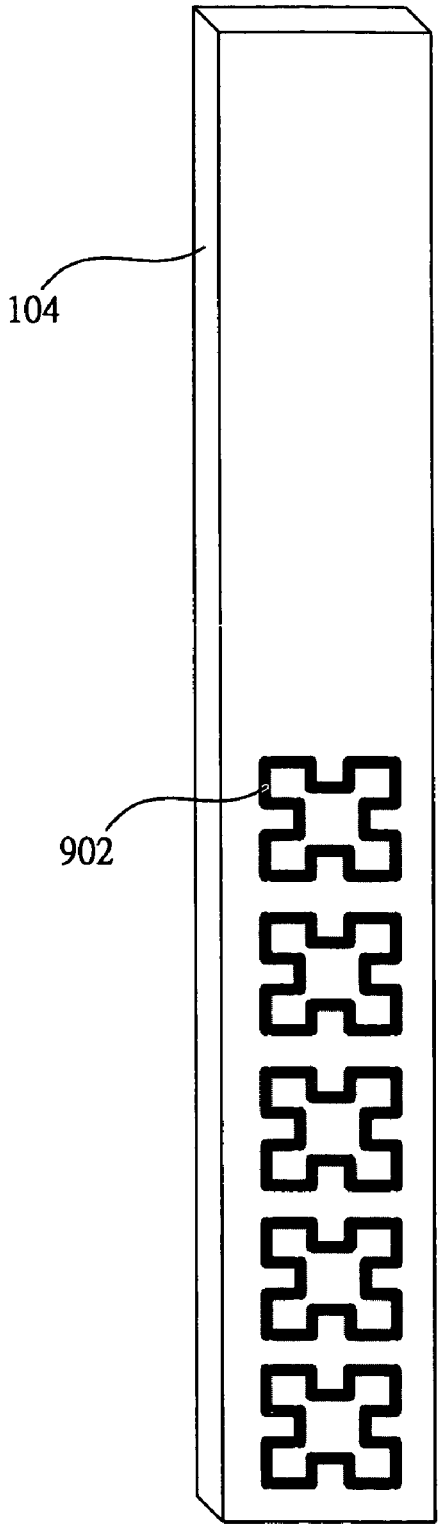
FIG. 9A illustrates a schematic view of the eighth embodiment of the present invention.

FIG. 9A illustrates a schematic view of the eighth embodiment of the present invention. In this embodiment, the electromagnetic scattering structure comprises a plurality of meandered square units 904. The circumference of each of the meandered square units 904 is an integer multiple of the corresponding wavelength at the central working frequency. The widths of the meandered square units 904 are not critical. In this embodiment, the widths of the meandered square units 904 are 6 mm.

The meandered square units 904 are arranged in rows and in front of the antenna inside the radome 104 (i.e. the array antenna 102 as illustrated in FIG. 1). Moreover, the meandered square units 904 are configured only on the lower half of the radome 104.

Figure 9B:
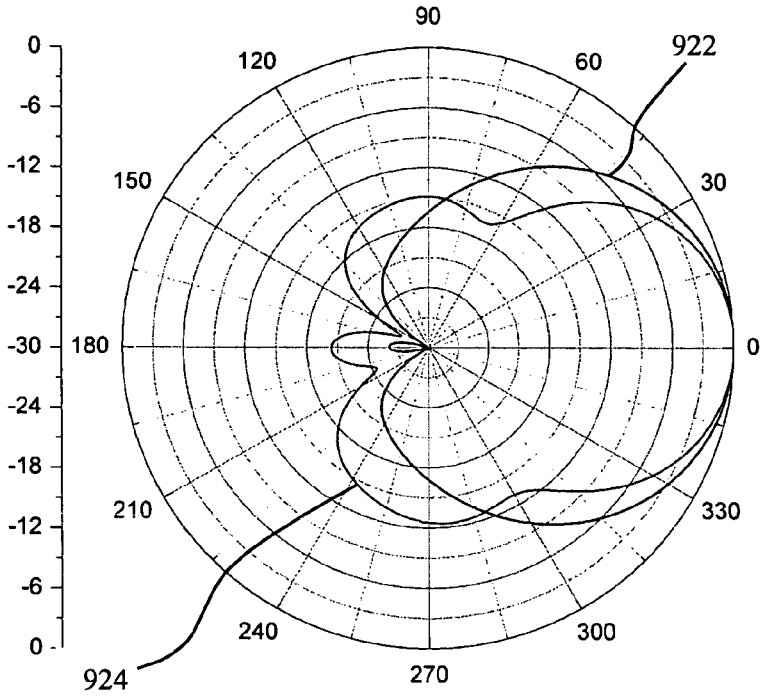
FIG. 9B illustrates a far-field antenna radiation pattern in the horizontal plane of the eighth embodiment.
Figure 9C:
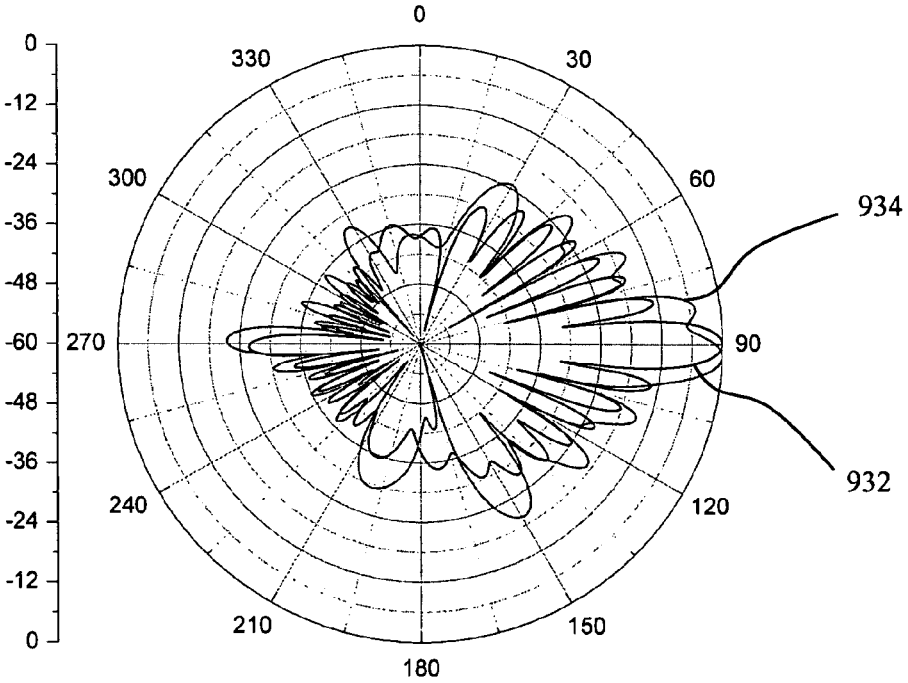
FIG. 9C illustrates a far-field antenna radiation pattern in the vertical plane of the eighth embodiment.

FIG. 9B illustrates far-field antenna radiation patterns in the horizontal plane of the eighth embodiment, and the radial axis thereof represents the relative field value in dB. The curve 922 is the antenna radiation pattern without the electromagnetic scattering structure of the embodiment, and the curve 924 is the antenna radiation pattern of the antenna with the electromagnetic scattering structure. FIG. 9C illustrates far-field antenna radiation patterns in the vertical plane of the eighth embodiment, and the radial axis thereof represents the relative field value in dB. The curve 932 is the antenna radiation pattern without the electromagnetic scattering structure of the embodiment, and the curve 934 is the antenna radiation pattern of the antenna with the electromagnetic scattering structure.

From FIGS. 9B and 9C, the level of the back lobe of the embodiment is about 5.5 dB higher than that of the antenna radiation pattern without the electromagnetic scattering structure, and the front-to-back ratio is reduced to about 20 dB. The energies radiating in the azimuths 60° and 300° are reduced, and the half-power beam width of the main lobe is reduced to about 50°. Moreover, the width of the main lobe in the vertical plane becomes greater, of which the half-power beam width is about 8.5°. In addition, the direction of main lobe is down-tilted by 2.5°.

Because the base stations are usually installed at high locations, in order to enhance the service to the mobile stations below, the prior art usually down-tilts the base-station antenna mechanically, and thus changes the direction of the main lobe in the vertical plane. Another conventional method to tilt the main lobe down is by properly adjusting the relative phase angles and amplitudes of the input currents of the antenna units 112. The embodiment provides another new way to increase the down-tilted angle of the main lobe for increasing the energy radiating downward in the vertical plane of the antenna radiation pattern. Hence, the embodiment improves the coverage quality of an elevated base station for the mobile stations positioned below.

The Ninth Embodiment

Figure 10A:
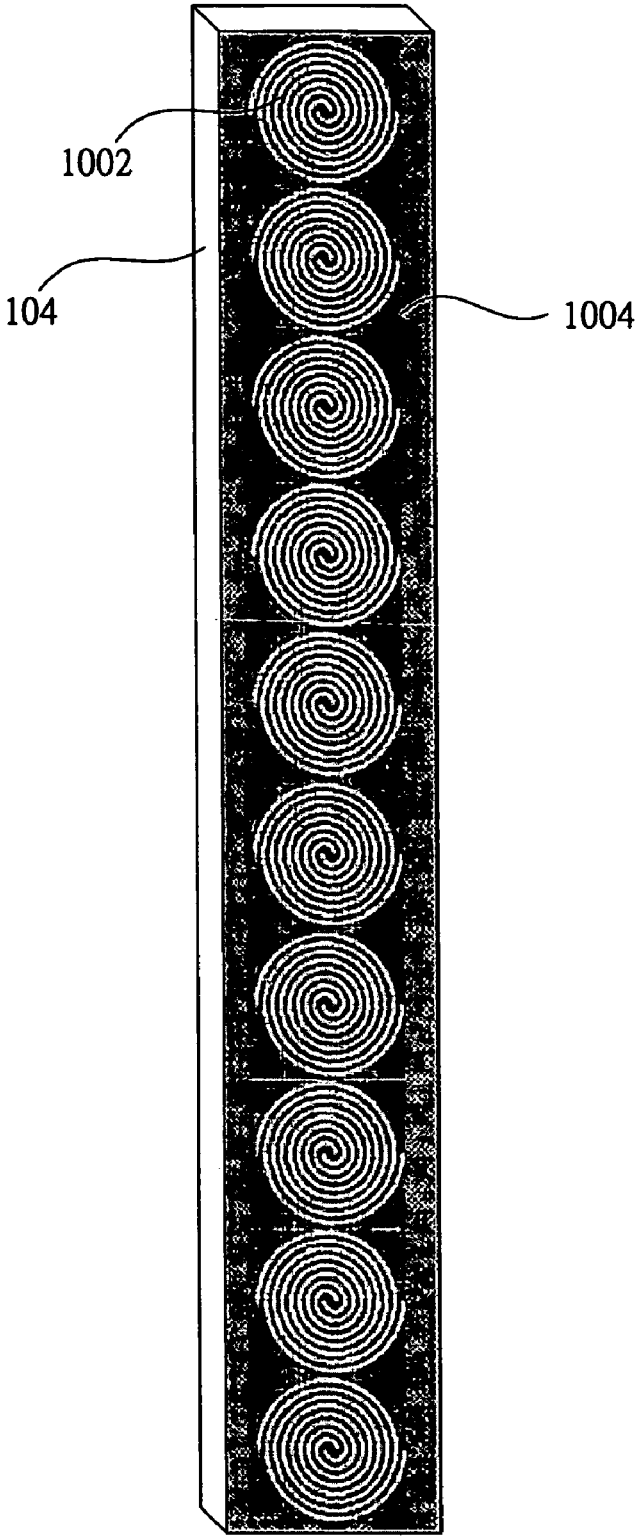
FIG. 10A illustrates a schematic view of the ninth embodiment of the present invention.

FIG. 10A illustrates a schematic view of the ninth embodiment of the present invention. In this embodiment, the electromagnetic scattering structure comprises a plurality of spiral slot units 1002. The spiral slot units 1002 are a plurality of openings of the conductive layer, and the widths of the spiral slot units are 4 mm. The material of other portions 1004, which are not the spiral slot units, is a conductive material such as, for example, metal, such as, for example, copper. The spiral slot units 1002 are arranged in rows and in front of the antenna inside the radome 104 (i.e. the array antenna 102 as illustrated in FIG. 1).

Figure 10B:
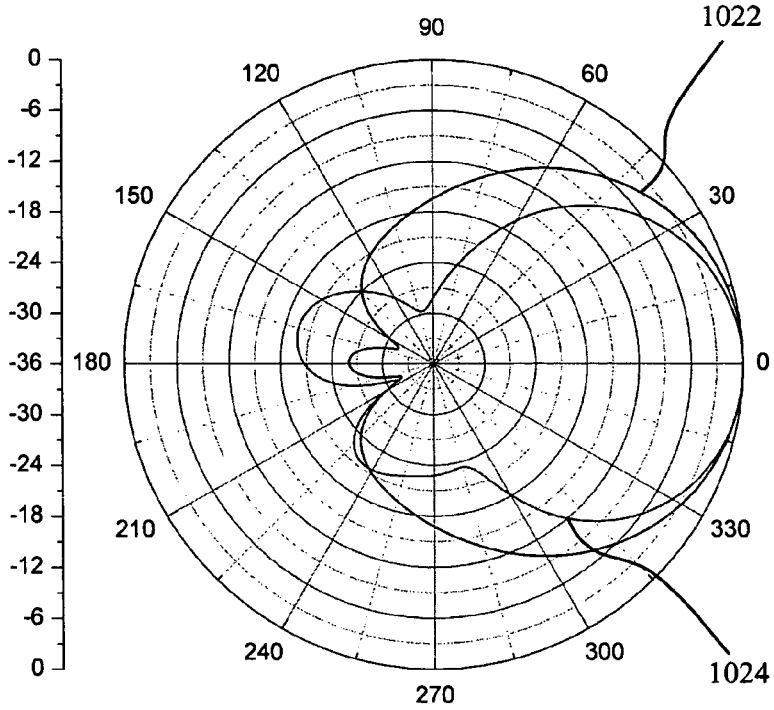
FIG. 10B illustrates a far-field antenna radiation pattern in the horizontal plane of the ninth embodiment.
Figure 10C:
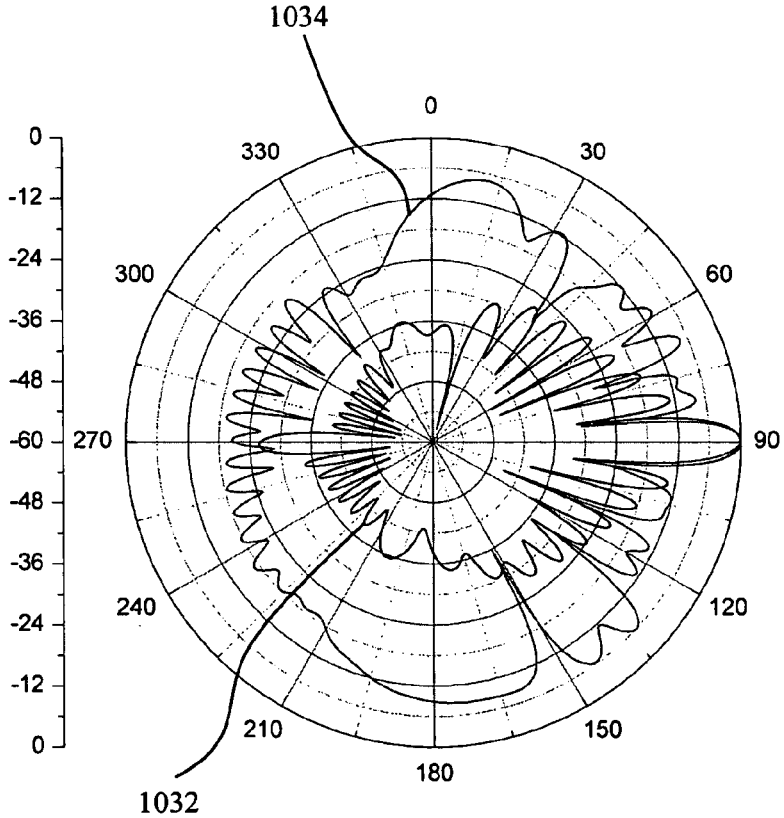
FIG. 10C illustrates a far-field antenna radiation pattern in the vertical plane of the ninth embodiment.

FIG. 10B illustrates far-field antenna radiation patterns in the horizontal plane of the ninth embodiment, and the radial axis thereof represents the relative field value in dB. The curve 1022 is the antenna radiation pattern without the electromagnetic scattering structure of the embodiment, and the curve 1024 is the antenna radiation pattern of the antenna with the electromagnetic scattering structure. FIG. 10C illustrates far-field antenna radiation patterns in the vertical plane of the ninth embodiment, and the radial axis thereof represents the relative field value in dB. The curve 1032 is the antenna radiation pattern without the electromagnetic scattering structure of the embodiment, and the curve 1034 is the antenna radiation pattern of the antenna with the electromagnetic scattering structure.

From FIGS. 10B and 10C, in the vertical plane, the antenna radiation pattern of the embodiment varies significantly from that without the electromagnetic scattering structure. In the horizontal plane, the levels of the antenna radiation pattern in side directions are lower than those without the electromagnetic scattering structure, and the half-power beam width of the main lobe is reduced to 52°.

In conclusion, the invention effectively and conveniently changes the antenna radiation pattern without any change of the original size and appearance of the base-station antenna. The invention has various practical implementations, such as a film sticker having the electromagnetic scattering structure of the invention manufactured for being adhered directly on the radome of the base station. Moreover, optional radomes with different functions can be provided for base stations of a certain model. According to requirements of different areas, the mobile communication operators properly choose and replace radomes to improve the performance of the base-station antennas for the service regions thereof. Alternatively, when the base-station antennas are manufactured, the radomes with different functions can also be prepared to be selected by the mobile communication operators.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A radome for an antenna, comprising:

a shell arranged to enclose the antenna; and a patterned conductive layer having a pattern, configured on the shell, wherein the pattern is designed according to a central working frequency of the antenna to change antenna radiation patterns of the antenna, and the pattern comprises a plurality of U-shaped combinations arranged periodically and each of the U-shaped combinations has a first U-shaped unit and a second U-shaped unit, wherein a length of the first U-shaped unit is equal to a corresponding wavelength at the central working frequency, and a length of the second U-shaped unit is two times the corresponding wavelength at the central working frequency.

2. A radome for an antenna, comprising:

a shell arranged to enclose the antenna; and a patterned conductive layer having a pattern, configured on the shell, wherein the pattern is designed according to a central working freguency of the antenna to change antenna radiation patterns of the antenna and the pattern comprises a plurality of meandered square units arranged periodically, and a circumference of each of the meandered square units is an integer multiple of a corresponding wavelength at the central working frequency.

3. A radome for an antenna, comprising:

a shell arranged to enclose the antenna; and a patterned conductive layer having a pattern, configured on the shell, wherein the pattern is designed according to a central working frequency of the antenna to change antenna radiation patterns of the antenna, and the pattern comprises a plurality of cross units and a plurality of strip units arranged periodically, the strip units are placed on two sides of the shell, and each of the cross units is placed between two corresponding strip units, and wherein each of the cross units comprises two strip portions with identical lengths, a length of each strip portion is 0.45 times a corresponding wavelength at the central working frequency, and a length of each strip unit is half of the corresponding wavelength at the central working frequency.

4. A radome for an antenna, comprising:

a shell arranaed to endose the antenna; and a patterned conductive layer having a pattern, configured on the shell, wherein the pattern is designed according to a central working freguency of the antenna to change antenna radiation patterns of the antenna, and the pattern comprises a plurality of meandered square units and a plurality of strip units arranged periodically, the strip units are placed on two sides of the shell, and each of the meandered square units is placed between two corresponding strip units, and wherein a length of each strip unit is half of a corresponding wavelength at the central working frequency, and a circumference of each meandered square unit is an integer multiple of the corresponding wavelength at the central working frequency.

5. A radome for an antenna, comprising:

a shell arranged to enclose the antenna; and a patterned conductive layer having a pattern, configured on the shell, wherein the pattern is designed according to a central working frequency of the antenna to change antenna radiation patterns of the antenna, and the pattern comprises a plurality of meandered square units arranged periodically, a circumference of each of the meandered square units is an integer multiple of a corresponding wavelength at the central working frequency, and the meandered square units are configured only on the lower half of the shell.

* * * * *